United States Patent [19]

Marran

[11] 4,425,875

[45] Jan. 17, 1984

[54] WOUND BOILER WITH REMOVABLE AND REPLACEABLE COMBUSTION CHAMBER

[76] Inventor: John D. Marran, Overleigh Rd., Bernardsville, N.J. 07924

[21] Appl. No.: 335,877

[22] Filed: Dec. 30, 1981

[51] Int. Cl.[3] ..... F22B 11/00; F22B 21/26

[52] U.S. Cl. ..... 122/134; 122/261; 126/144

[58] Field of Search ..... 122/134, 135 R, 233, 122/261, 17, 51, 135 F, 136 R, 149, 367 A; 126/144; 431/347

[56] References Cited

U.S. PATENT DOCUMENTS

| | | | |
|---|---|---|---|
| 844 | 7/1838 | Vanorder | 122/134 |
| 1,339 | 9/1839 | DeWitt | 122/134 |
| 26,788 | 1/1860 | Schaubel | 122/134 |
| 1,223,674 | 4/1917 | Dearing | 122/134 |
| 1,556,189 | 10/1925 | Wilson | 122/261 |
| 3,236,212 | 2/1966 | Ospelt | 122/136 R |
| 3,266,466 | 8/1966 | Fehr | 122/136 R |
| 4,188,917 | 2/1980 | Asman | 122/134 |
| 4,261,299 | 4/1981 | Marran | 122/134 |

FOREIGN PATENT DOCUMENTS

| | | | |
|---|---|---|---|
| 432034 | 7/1926 | Fed. Rep. of Germany | 122/134 |
| 81904 | 11/1934 | Sweden | 122/134 |
| 611 | of 1906 | United Kingdom | 122/134 |

*Primary Examiner*—Henry C. Yuen
*Assistant Examiner*—David Helmbold
*Attorney, Agent, or Firm*—Daniel H. Bobis

[57] ABSTRACT

A combustion chamber and liner for use in a wound boiler formed from a heat exchanger slab rolled into a plurality of wound heat exchanger convolutions, the inner heat exchanger convolutions defining a space in which a sized and shaped elongated hollow cylindrical member defining the fire box is removably mounted and in assembled position forms an inner annular combustion gas flow passage disposed to communicate with an outer combustion gas flow passage, the cylindrical member has means to position and orient the cylindrical member in assembled position so that a top inlet in the wall of the cylindrical member in association with an aligning and guide member will pass combustion gases from the fire box into the inner combustion gas flow passage, in a direction counter to the flow of combustion in the fire box, and the outer combustion gas flow passage is disposed to communicate with a suitable flue or discharge outlet to pass residual combustion gases to waste.

9 Claims, 8 Drawing Figures

WOUND BOILER WITH REMOVABLE AND REPLACEABLE COMBUSTION CHAMBER

BACKGROUND OF THE INVENTION

This invention relates generally to low thermal mass boilers and more particularly to a wound boiler having an improved free standing, removable and replaceable combustion chamber therein.

In U.S. Pat. No. 4,261,299 a wound boiler is shown having a centrally disposed generally elongated fire box defined by the innermost heat exchanger convolutions of a heat exchanger slab which is wound upon itself around the longitudinal axis for the boiler in a plurality of heat exchanger convolutions. The innermost heat exchanger convolution and the next adjacent heat exchanger convolution of the slab being disposed in spaced relation to each other so as to define an exit at the lower section of the fire box through which hot gaseous combustion products exit and which provides communication with the spaced passages formed between the convolutions to conduct the products of combustion from the fire box to an expansion space and its associate exhaust stack or flue for the wound boiler to provide means for passing waste combustion products therefrom.

In U.S. Pat. No. 4,261,299 the combustion chamber or fire box is preferably lined with a refractory material to improve combustion therein or the fire box is sized to permit better combustion without a refractory liner.

U.S. Pat. No. 4,261,299 follows conventional wet base boiler arrangements wherein the radiation from the flame to the boiler heat exchanger surface is used to enhance heat transfer. However, instead of passing the combustion gases through a port in the top of the combustion chamber or fire box to in turn communicate with the exhaust stack, this patent discharged the gaseous products of combustion out of an exit port in the lower section of the fire box in communication with another heat exchanger flow passage before the waste combustion products are passed to the exhaust stack or flue. This improved residence time for the flame in the center of the fire box and heat transfer with the convoluted heat exchanger surfaces. It was found that the operatively associated convoluted combustion gas passages of the wound boiler reduced the exhaust stack temperature of the waste combustion products significantly thus increasing the efficiency of the wound boiler.

However, the exit port in the lower section of the combustion chamber or fire box in U.S. Pat. No. 4,261,299 caused problems in that unburned hydrocarbons, non-condensible gases such as nitrogen and $CO_2$ from the burning process and droplets of unburned hydrocarbons collected at the top of and on the walls of the firebox would inhibit combustion more particularly on cold start-ups.

The direct application of refractory materials to the adjacent heat transfer surfaces defining the combustion chamber or fire box as shown in U.S. Pat. No. 4,261,299 severely impeded heat transfer. It however improved flame propogation by radiation and reduced impingement but caused stack temperatures to increase dramatically.

In the present invention these problems are overcome by inserting a free standing heavily insulated generally elongated hollow cylindrical member within the space defined by the innermost convolution of the wound slab so that it lies in spaced relation to the innermost heat exchanger convolution and forms or defines a combustion chamber or fire box therein and an extra or additional inner substantially annular elongated combustion products flow passage between the outer surface thereof and the wall of the innermost heat exchanger convolution. The combustion chamber formed in the hollow cylindrical member is sized and shaped with a volumetric capacity to permit completion of combustion therein and is further provided with a slotted opening at the top section remote from the fuel inlet end of the combustion chamber which slotted opening coacts with a turning guide on the cylinder member adjacent thereto to direct and turn the gaseous products of combustion so they pass from the slotted opening in a reverse flow direction through the inner annular elongated combustion products flow passage, initially, parallel to the longitudinal axis of the wound boiler and then radially downward about the outside or exterior surface of the hollow cylindrical member to exit through the exit port formed between the inner most heat exchanger convolution and the next adjacent heat exchanger convolution formed by the wound horizontal heat exchanger slab. The combustion products then flow to an outer combustion product flow passage which in turn communicates with the expanded gas passage and the exhaust stack in the same manner as above described for U.S. Pat. No. 4,261,299.

This construction acts to eliminate dead spots at the top section of the combustion chamber because the flow pattern through a top exhaust is more normal for hot gaseous combustion products. The extended flow pattern for the hot gaseous combustion products acts to permit completion of combustion thus reducing the problem of collected unburned hydrocarbons and non-condensible gases and the peripheral gas flow around the sides of the outer surface of the cylindrical member acts to improve heat transfer to produce or further significantly drop in the exhaust stack temperatures of approximately 50° F. as compared to an equivalent design with the same size heat transfer surfaces.

While this construction reduced radiation from the flame which is propogated and confined within the combustion chamber defined by the hollow cylindrical member which would normally decrease heat transfer, it has been found that an improvement in heat transfer efficiency has been obtained possibly due to improved velocity control and due to the increased flow path length of the hot combustion gases as they pass about the outside of the cylindrical member through the additional inner combustion gas flow passage formed between the outer surface of the combined combustion chamber and liner member and the inner wall of the innermost heat exchanger convolution of the heat exchanger slab of the wound boiler.

SUMMARY OF THE INVENTION

Thus, the present invention covers a combustion chamber and liner for use in a wound boiler having, a plurality of spaced wound heat exchanger convolutions defining a central space and combustion gas flow passages comprising, sized elongated generally hollow cylindrical means having an inner wall defining a fire box, top outlet means formed in the cylindrical means disposed to communicate with the combustion gas flow passages to pass hot gaseous combustion products from the combustion chamber to said combustion gas flow passages, and means on the cylindrical means to position the cylindrical means in the wound boiler so that the discharge outlet is disposed for communication with the combustion gas flow passages.

Additionally, the combustion chamber and liner as above described with, guide and turning means on the cylindrical means operatively associated with the top outlet means to guide and turn the hot gaseous combustion products from the combustion chamber to flow into the combustion gas flow passages in a direction counter to the direction of flame propogation in said combustion chamber.

Additionally, the present invention covers the combination with a wound boiler having a plurality of wound heat exchanger convolutions including, an inner heat exchanger convolution forming a central space and an outer heat exchanger convolution spaced from said inner heat exchanger convolution to form therewith an outer flow passage for hot gaseous combustion products of a combustion chamber including, a shaped and sized generally hollow cylindrical means defining a fire box therein, means for mounting the cylindrical member in said central space in spaced relation to the innermost of said plurality of wound heat exchanger convolutions to define therewith an inner flow passage for hot gaseous combustion products, top outlet means formed in said cylindrical member and disposed to communicate with said inner flow passage to pass hot gaseous combustion products thereto from the fire box, said inner flow passage in communication with the outer combustion gas flow passage for said wound boiler, and an exhaust means connected to said outer combustion gas flow passage for passing waste products of combustion from the wound boiler.

Additionally, the combination as above described with, guide and turning means on the cylindrical means operatively associated with the top outlet means to guide and turn the hot gaseous combustion products from the combustion chamber to flow into the inner flow passage in a direction counter to the direction of flame propogation in said fire box.

Accordingly, it is an object of the present invention to provide a wound boiler having an improved combustion chamber and liner unit therein arranged to pass and reverse the flow of the gaseous products of combustion from the combustion chamber in a manner to pass in close proximity to the innermost heat transfer wall of the wound boiler with sufficient velocity and turbulance to enhance heat transfer.

It is another object of the present invention to provide an improved combustion chamber and liner unit for a wound boiler designed to provide substantially complete combustion and provided with a generally top exit for the hot gaseous combustion products to eliminate dead areas or areas lacking sufficient oxygen to support combustion therein.

It is another object of the present invention to provide an improved combustion chamber and liner unit for a wound boiler which is mounted therein so as to create an additional annular inner length of flow passage for the hot combustion gases and which is constructed and arranged in the wound boiler to redirect the combustion gases vertically downward on either side of the exterior surface of the combustion chamber and liner unit to an exit port below the combined combustion chamber and liner unit.

It is another object of the present invention to provide a hollow elongated cylindrical member which defines a combustion chamber and liner unit for use in a wound boiler adapted to shield the flame in the fire box therein from cooled or cold heat exchange surfaces which will tend to chill and reduce flame radiation patterns, and to enhance the complete combustion of all fuel entering the fire box.

It is another object of the present invention to provide a hollow, elongated cylindrical member which defines a combustion chamber and liner for use in a wound boiler so shaped and sized as to create therein heat reflection and radiation back towards the flame propogation area in the fire box therein to enhance development of vaporization of the atomized fuel entering the fire box.

It is still another object of the present invention to provide an improved cylindrical member which defines a combined combustion chamber and liner use in a wound boiler which acts to contain high radiation levels within the fire box therein and prevents radiant heat loss axially from the cylindrical member through the front and back end walls of the wound boiler.

It is still another object of the present invention to provide an improved cylindrical member which defines a combined combustion chamber and insulating liner for use in a wound boiler which acts to contain the high radiation levels occurring during combustion in the fire box therein and prevents axial heat loss by conduction from the cylindrical member through the target or back wall thereof by providing in assembled position an open space between the back wall of the cylindrical member and the adjacent back end closure of the wound boiler.

It is still another object of the present invention to provide a hollow, elongated cylindrical member which defines an improved combined combustion chamber and liner for use in a wound boiler which is freestanding, can be easily installed and removed from the wound boiler to permit servicing of heat exchange surfaces and burner parts without breaking the basic gas type seals of the wound heat exchanger slab in the wound boiler.

It is still another object of the present invention to provide a hollow, elongated cylindrical member which defines an improved combustion chamber and liner for use in a wound boiler which is mountable therein with adequate clearance between the exterior of the cylindrical member and the adjacent heat transfer surfaces to form an additional/axially disposed flow passage therewith and which will also provide means to permit access for cleaning of the adjacent heat transfer surfaces without removal of the cylindrical member from assembled position if desired.

It is still another object of the present invention to permit the heat exchange surfaces of the wound boiler to be cooled by purging at the end of each heat cycle or combustion cycle of operation to reduce to a minimum standby losses and to facilitate clean cold restarting of the wound boiler.

It is a still further object of the present invention to provide a hollow, elongated cylindrical member which defines an improved combustion chamber and liner for use in a wound boiler which will provide an ideal burning environment for either liquid or gaseous fuels so that the same unit may be used for oil, gas or for combination fuel burners with minimum adjustment of the firing rate, the flame propogation being sufficiently rapid in the improved combustion chamber and liner to permit the desired firing rate in the volumetric space provided.

These objects and advantages as well as other objects and advantages will be better understood with reference to the following description of a wound boiler having an improved combined combustion chamber and liner unit in accordance with the present invention which is shown and illustrated in the drawings in which:

DESCRIPTION OF THE PREFERRED EMBODIMENT

Figure 1:
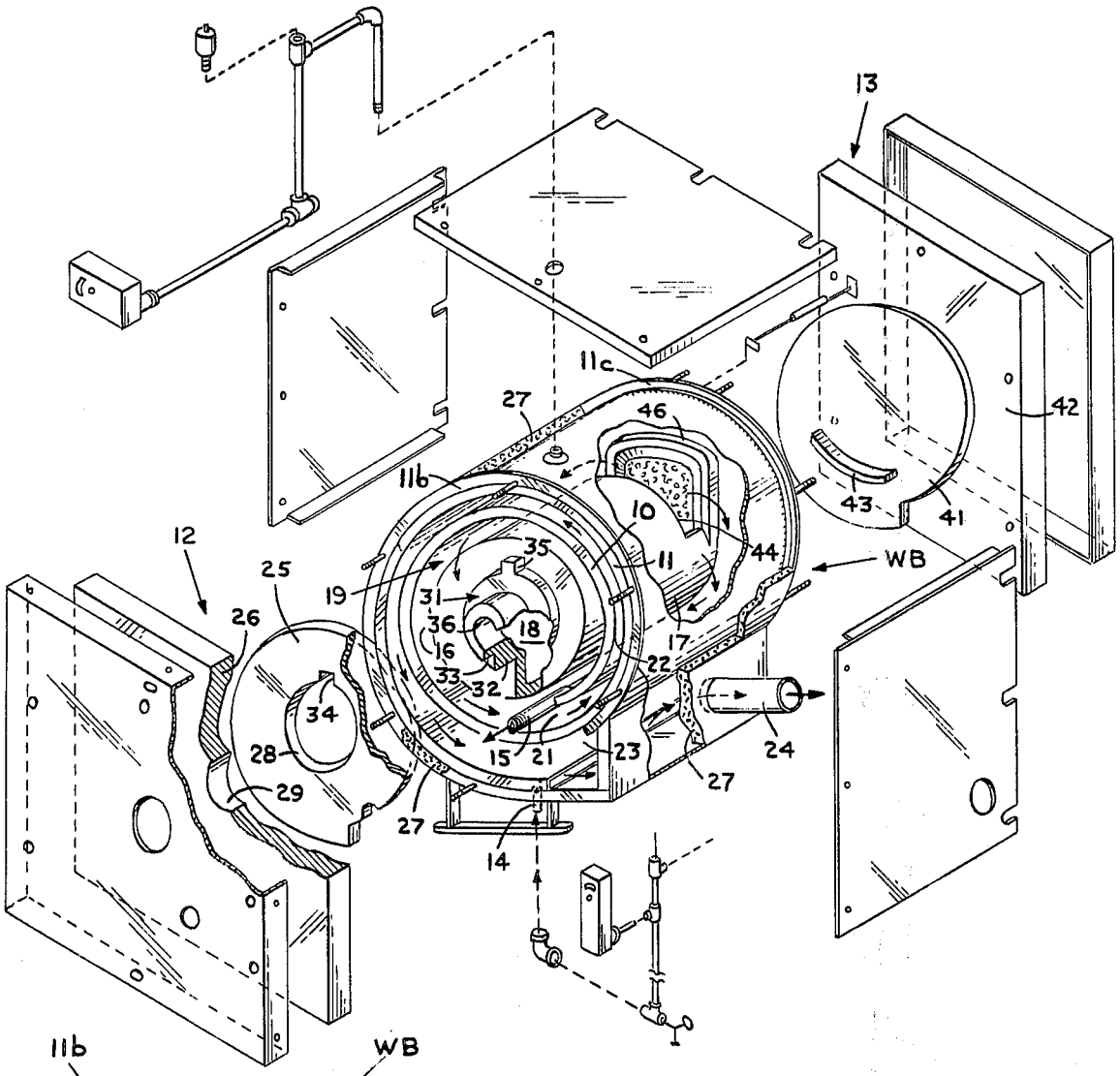
FIG. 1 is a perspective exploded view of a horizontally wound slab boiler partly broken away in vertical section to show the improved free standing hollow, elongated cylindrical member defining a preferred form of combined combustion chamber and liner unit in accordance with the invention therein.

Referring to the drawings FIG. 1 shows an exploded perspective view of a wound boiler designated WB wherein a generally elongated hollow hermetically sealed slab generally rectangular in cross-section has been wound upon itself into a plurality of heat exchanger convolutions concentric to the longitudinal axis of the wound boiler and to each other and in spaced relation, to form an inner heat exchanger convolution 10 and an outer heat exchanger convolution 11, in the manner more fully shown and described in U.S. Pat. No. 4,261,299. Preferably removably rather than fixedly connected to the respective front and back ends of the inner heat exchanger convolution 10 and outer heat exchanger convolution 11 transverse to the longitudinal line or axis of the wound boiler WB are a front end closure generally designated 12 and a back end closure generally designated 13. The heat exchange medium generally water enters the outer heat exchanger convolution 11 through an inlet pipe 14 and after the heat exchange medium flows through the hermetically sealed slab to the innermost heat exchanger convolution 10, it discharges through the outlet pipe 15. This flow pattern as in the case of U.S. Pat. No. 4,261,299 will pass the heat exchange medium in a direction counter to the direction of flow of the hot gaseous combustion products which are the source of the heat for heating the heat exchange medium in the wound boiler WB. The initial flow being through the outer heat exchanger convolution 11 it will act to maintain the exterior surfaces 11*a* of the wound boiler at the lowest temperature.

Figure 2:
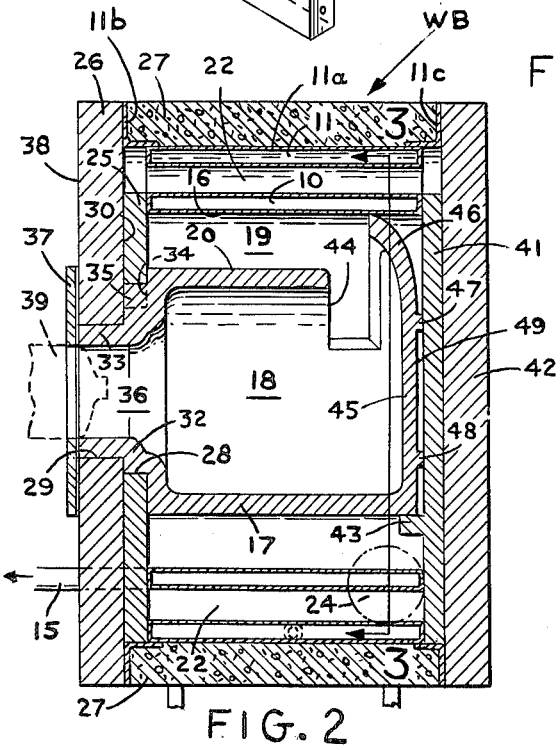
FIG. 2 is a longitudinal cross-section taken through the wound boiler shown in FIG. 1.
Figure 3:
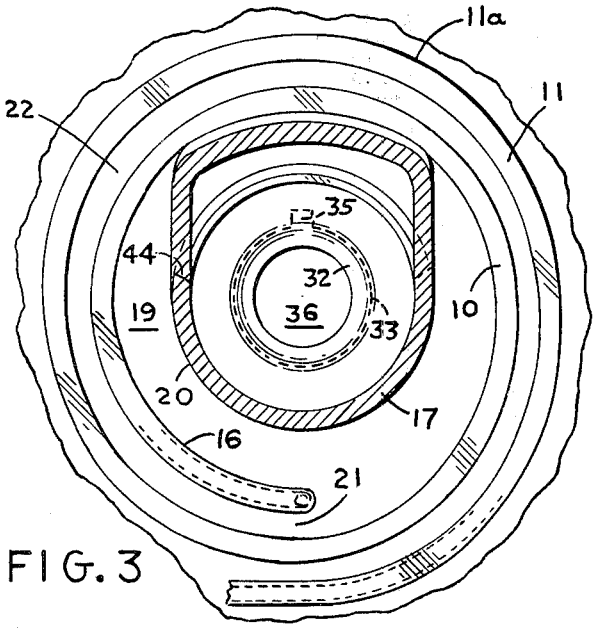
FIG. 3 is a cross-section taken through line 3—3 of FIG. 1.
Figure 4:
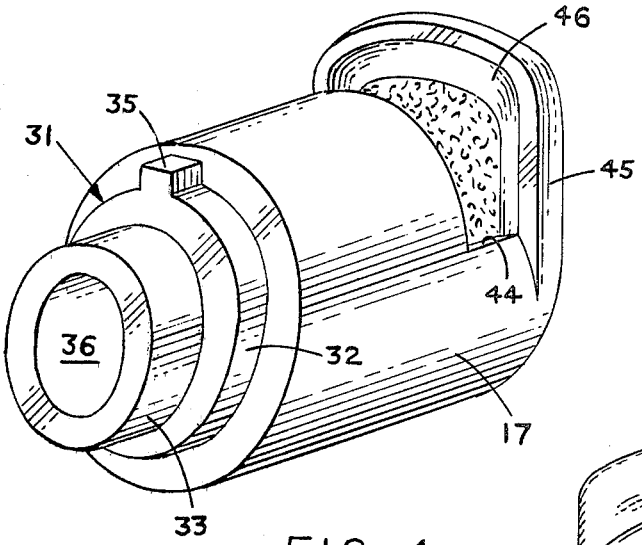
FIG. 4 is a perspective view of the hollow, elongated cylindrical member defining the combined combustion chamber and liner shown in FIG. 1.
Figure 5:
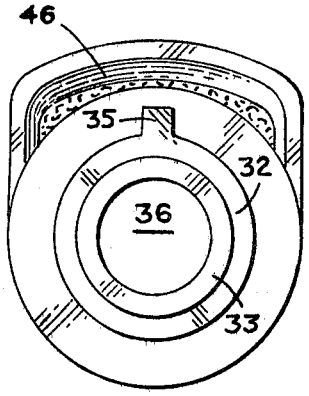
FIG. 5 is a front end view of the combined combustion chamber and liner shown in FIG. 4.
Figure 6:
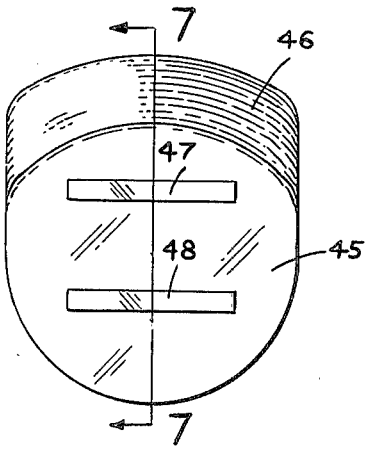
FIG. 6 is a back end view of the combined combustion chamber and liner shown in FIG. 4.

The innermost wall 16 of the heat exchanger convolution 10 is so wound that it forms a relatively large central space in the wound boiler WB in which a hollow elongated cylindrical member 17 defining the combustion chamber and liner in accordance with the present invention generally designated 17*a* is mounted as hereinafter described. In the hollow portion of the hollow elongated cylindrical member the fire box 18 is formed by the inner wall thereof for the wound boiler WB and fire box 18 will be sized and shaped to provide a volumetric capacity for optimizing combustion therein and further the fire box 18 is provided with an outlet or port 44 hereinafter more fully referred to for communication with the flow passages for hot combustion gases operatively associated with the walls of the heat exchanger convolutions 10 and 11 as is shown by FIGS. 1, 2 and 3 of the drawings and will be now described.

Thus the hollow elongated cylindrical member 17 will have a diameter less than the inner wall 16 of the inner heat exchanger convolution 10 which defines a central space so that when the hollow elongated cylindrical member 17 is mounted in this central space an elongated inner annular flow passage 19 for hot combustion gases is formed between the outer wall or surface 20 of the hollow, elongated cylindrical member 17 and the inner wall 16 of the inner heat exchanger convolution 10.

Since the inner heat exchanger convolution 10 and the outer heater convolution 11 are wound so that they are disposed in spaced relation to each other, there is formed in the lower section of the inner annular flow passage 19 where the end of the inner heat exchanger convolution 10 ends and the outer heat exchanger convolution 11 begins an elongated transfer or exit port 21 which extends substantially the full longitudinal length of the wound boiler WB between the front end closure 12 and the rear end closure 13.

Transfer or exit port 21 connects the inner annular flow passage 19 to a circumferential outer flow passage 22 which in turn communicates with an expansion space 23 having an exhaust port 24 for venting the waste gaseous combustion products to an exhaust stack or flue, not shown, for the wound boiler WB.

The front end closure 12 consists of an inner back closure member member 25 and an outer front closure member 26. Inner front closure member 25 will have an approximate thickness of 1" and will be made of a high temperature refractory material capable of withstanding the combustion gas temperatures which can be upwards of 2300° F. Further inner front closure member 25 is smaller than the outer front closure member 26 and fits into and coacts with the inner heat exchanger convolution 10 to close the front of the central chamber or space into which the elongated cylindrical member 17 which forms the fire box 18 will be fitted. The outer front closure member 26 will have an approximate thickness of 2" and will be made of a medium temperature refractory material capable of withstanding combustion gas temperatures in the outer flow passages 21, 22 and 23 which can be upwards of 1900° F. Outer front closure member 26 being larger than the inner front closure member 25 will extend radially outward so as to coact with the front end of the outer heat exchanger convolution 11 and to close the front end of the outer combustion gas flow passage 22 by compression against seal ring 11*b* formed on the outer heat exchange convolution 11 as shown in FIGS. 1 and 2 of the drawings.

The outer front closure member 26 will be sufficiently large to extend beyond the exterior wall of the outer heat exchanger convolution 11 so as to coact with the back end closure 13 which has a substantially similar size so that any suitable type of exterior insulation as at 27 may be connected to the outer face of the outer heat exchanger convolution 11 to prevent excessive heat loss through the exterior surfaces 11*a* of the wound boiler WB.

Extending end to end through the front end closure 12 are a pair of aligned openings as at 28 in the inner front closure member 25 and at 29 in the outer front closure 26. Opening 28 in the inner front closure member 25 has a larger diameter then the opening 29 in the outer front closure member 26 to form a shoulder 30 on the inner face of the outer front closure member 26. The hollow cylindrical member 17 is provided with a neck section generally designated 31 which is formed or shaped to fit through the openings 28 and 29 and has corresponding annular sections as at 32 and 33, section 32 being of a greater diameter then section 33 so that the neck section 31 can in assembled position fit snugly in and through the openings 28 and 29 to provide means for supportably mounting the front end of the hollow cylindrical member 17 in assembled position in the would boiler WB.

Further, in order to orient and fix the position of the hollow cylindrical member 17 in the wound boiler, a keyway 34 is formed in the opening 28 and a key member 35 is formed on the outer diameter of the section 32 of the neck section 31 which interfits into the keyway 34 when the hollow cylindrical member 17 is in assembled position.

Further the inner annulus of the neck section 31 defines a burner opening 36 which extends therethrough and communicates with the combustion chamber 18 formed in the hollow cylindrical member 17 so that a burner flange 37 connected to the outside face 38 of the wound boiler supports the nozzle end of the burner 39 which extends into the burner opening 36 so that in assembled position the burner nozzle will be disposed to provide optimum flame propogation for whatever fuel is utilized and discharge for combustion into the combustion zone 18 of the hollow cylindrical member 17.

The back end closure 13 similar to the front end closure 12 consists of an inner back closure member 41 and an outer back closure member 42. Inner back closure member 41 will have an approximate thickness of 1" and will be made of a high temperature refractory material capable of withstanding combustion gas temperatures which can be upwards of 2300° F.

Further inner back closure member 41 will be smaller than the outer back closure member 42 and will fit into and coact with the inner heat exchanger convolution 10 to close the back end of the central chamber or space into which the hollow elongated cylindrical member 17 which forms the combustion chamber 18 will be fitted. The outer back closure member 41 will have an approximate thickness of 2" and will be made of a medium temperature refractory material capable of withstanding the combustion gas temperatures in the outer flow passages 21, 22 and 23. Outer back closure member 42 being larger than the inner back closure member 41 will extend radially outward so as to coact with the back end of the outer heat exchanger convolution 11 and seal ring 11*c* formed on the outer heat exchanger convolution and to close the back end of the outer combustion gas flow passage 21. The outer back closure member 42 will be sufficiently large to extend beyond the exterior wall of the outer heat exchanger convolution 11 so as to coact with the outer front closure member 26 of the front end closure 12 which has a substantially similar size so that any suitable type of exterior insulation as at 27 may be connected to the exterior face 11*a* of the outer heat exchanger convolution 11 to prevent excessive heat loss through the exterior surfaces of the wound boiler WB.

Figure 7:
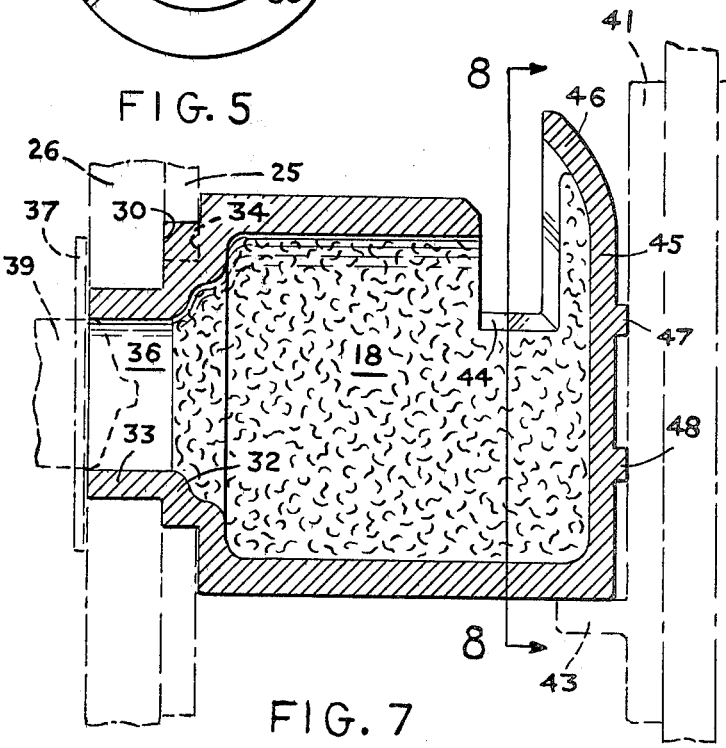
FIG. 7 is a longitudinal cross-section taken on line 7—7 of FIG. 5.

The inner back closure section 41 is provided with an arcuate support flange 43 which is close to the lower section of the inner annular flow passage 19 and is so shaped and positioned that it will serve as a support for the back end of the hollow elongated cylindrical member 17 all of which is shown in FIGS. 1, 2 and 7 of the drawings.

Figure 8:
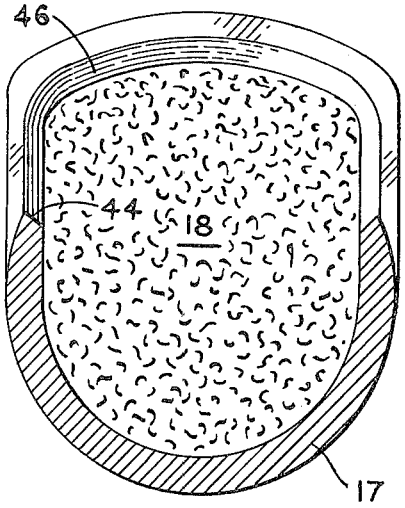
FIG. 8 is a cross-section taken on line 8—8 of FIG. 7 showing the turning guide associated with the top outlet means on the combustion chamber and lines shown in FIGS. 1, 4, 5, 6 and 7.

When the hollow cylindrical member is moved into assembled position one method of connecting the hollow cylindrical member 17 is to first position the back end on the arcuate support bracket 43. Then the front end closure is assembled about the neck section 31 and the key 35 oriented to fit into the key way 34 so as to fix the hollow elongated cylindrical member 17 in assembled position for reasons that will appear clear from the description which follows in regard to the flow of the hot combustion gases from the fire box 18 through the opening or port 44 provided in the wall of the hollow elongated cylindrical member 17 at the upper back end thereof which provides communication between the fire box 18 and the inner annular flow passage 19 as is shown in FIGS. 1, 2 and 8 of the drawings.

One preferred form of hollow elongated cylindrical member 17 for defining the fire box 18 is shown in FIGS. 4, 5, 6, 7 and 8 of the drawings. Hollow cylindrical member 17 is formed from an easily moldable insulating type material having an approximate wall thickness of about $\frac{5}{8}$". The insulating material selected will be capable of withstanding temperatures in excess of the high temperatures of the gaseous products of combustion generated in the fire box 18 which will be in the order of 2300° F. Further the insulating material will have a low coefficient of thermal conductivity so that during combustion the inner wall of the cylindrical member 17 defining the fire box 18 will heat up rapidly and radiate surface temperatures back into the flame propogation area of the fire box which improves vaporization of the fuel and thus increases combustion efficiency even on cold starts.

Since the insulating material has a low coefficient of thermal conductivity the heat transfer between the inner wall defining the fire box 18 and the outer surface 20 of the cylindrical member will be relatively low and since the outer wall 20 of the cylindrical member is adjacent the inner wall 16 of the inner heat exchanger convolution this inner wall 16 acts as an absorber as heat energy to keep the exterior surface 20 of the cylindrical member cool.

On the portion of the cylindrical member 17 which forms the top wall in assembled position, the arcuate relatively wide exhaust opening or port 44 is formed adjacent but inwardly of the back end wall 45 of the cylindrical member 17.

In assembled position this exhaust opening or port 44 will communicate with the inner annular flow passage 19 as is clearly shown in FIGS. 1, 2 and 7 of the drawings.

Continuous with the upper end of the back end wall 45 of the cylindrical member 17 is an arcuate guide section 46 which extends partially over and is operatively associated with the arcuate exhaust opening or port 44 in the top section of the cylindrical member 17.

The arcuate guide section 46 acts to guide and turn the hot gaseous combustion products so that they exhaust and flow from the fire box 18 in a direction opposite from the direction of the combustion flame propogated in the fire box 18 in the cylindrical member 17. The combustion gases will first flow into and through the inner annular flow passage 19 axially and then radially about the outer surface 20 of the cylindrical member 17.

The back end wall 45 of the cylindrical member 17 is also provided on the side of the combustion chamber and liner 17*a* remote from the fire box 18 with a plurality of spaced positioning tabs as at 47 and 48 which act to hold the cylindrical member 17 in spaced relation with the adjacent surface of the inner back closure member 41 of the back end closure 13. Thus, an air gap 49 is formed therebetween to cut down conductive heat loss from the cylindrical member 17 to the back end closure 13.

When fuel from the burner 39 is ignited in the combustion zone of the fire box 18 the flame is fully propogated in the combustion zone with minimal radiation heat loss to the adjacent confining walls of the cylindrical member 17. The hot gaseous combustion products are then free to expand through the top exhaust opening or port 44 in an inherently normal manner for heated gases which tend to rise. As the hot gaseous combustion products expand through port 44 the arcuate guide 46 acts to guide and turn the hot gaseous combustion products so that they flow axially and radially through the inner flow passage 19 and thus downwardly across the exterior surface of the cylindrical member 17. Simultaneously the hot gaseous combustion products enter into heat exchange relation with the inner wall 16 of the innermost heat exchanger convolution 10. The expanding gases will exhaust downwardly through the transverse exit port 21 into the annular outer flow passage 22 where the hot gaseous combustion products continue heat exchange relation with the inner wall of the outer heat exchanger convolution 11 until they eventually reach the expansion chamber or space 23 where they pass through the exhaust port 24 and are then vented through the exhaust stack or flue for the wound boiler WB in the conventional manner. Thus, the flow of the heat exchange medium is in a direction opposite from that of the hot gaseous combustion products. The heat exchange medium is preheated and progressively brought up to the hot gaseous combustion products temperature as it passes from the intake port 14 to the outlet or discharge port 15 which is connected to the associated system utilizing the water so heated in the wound boiler WB.

Thus an improved wound boiler and an improved combustion chamber and liner for use in a wound boiler has been described which is sized, has the volumetric capacity to permit completion of combustion within the chamber to permit normal exhaust and flow of hot gaseous combustion products therefrom, and is shaped and dimensioned to create an increased flow area and path length for improved heat transfer with the hot gaseous combustion products as they flow from the combustion chamber and liner to the stack or flue for the wound boiler.

It will be understood that the invention is not to be limited to the specific construction or arrangement of parts shown but they they may be widely modified within the invention defined by the Claims.

What is claimed is:

1. A combustion chamber and liner for use in a wound boiler having, a plurality of spaced heat exchanger convolutions forming a central space and combustion gas flow passages therein comprising;

a. an independent free standing sized, elongated, hollow cylindrical means having an inner wall means defining a fire box for combustion of fuel therein, b. said hollow cylindrical means made from an insulating material having a relatively low coefficient of thermal conductivity and capable of withstanding the relatively high temperatures of the gaseous products of combustion generated in the fire box, c. said hollow cylindrical means having, a charging inlet for fuel, and a discharge outlet in the wall means a spaced distance remote from the charging inlet, d. an arcuate extension and guide projecting from the cylindrical means at a point adjacent the discharge outlet to guide and turn the flow of combustion gases expanding from the fire box and to direct the same along the extension of the cylindrical means in an axial direction counter to the direction of flow of the combustion gases in the fire box, e. means defining a front shoulder about the charging inlet end of the hollow cylindrical means, and f. key means on said front shoulder for fixing and orienting the position of the cylindrical means in the wound boiler so that the discharge outlet is aligned and disposed to deliver combustion gases from the fire box to said combustion gas flow passages.

2. In a combustion chamber for a wound boiler as claimed in claim 1 wherein;

a. said discharge outlet in the wall means of the cylindrical means is oriented at the top section thereof in assembled position in the wound boiler, b. said cylindrical means has a back end closure, and c. the arcuate extension is adjacent the back end closure for operative association with the discharge outlet for guiding and turning hot gaseous combustion products expanding and flowing from the fire box in the cylindrical means.

3. The combination with a wound boiler having a plurality of wound heat exchanger convolutions including, an inner heat exchanger convolution forming a central space and an outer heat exchanger convolution spaced from said inner heat exchanger convolution to form therewith an outer flow passage for hot gaseous combustion products of, a combustion chamber and liner including, a. an independent, free standing, shaped and sized generally hollow cylindrical means having an inner wall means defining a fire box for combustion of fuels therein, b. means on said wound boiler forming a charging inlet for fuel disposed in communication with said fire box in the cylindrical means, c. said cylindrical means having a discharge outlet spaced from the charging inlet for the fuel, d. means on the wound boiler and on the cylindrical means for positioning and orienting the cylindrical means in the central space to form an inner flow passage for hot gaseous combustion products between the cylindrical means and the inner heat exchanger convolution disposed to communicate axially with said discharge outlet and radially with the outer flow passage, e. said wound boiler has a front end closure and a back end closure, f. said front end closure having a key slot formed therein, g. said means for positioning and orienting the cylindrical means includes, key means on said cylindrical means for operative connection into the key slot formed on the front end closure for the wound boiler, and h. vent means on the wound boiler in communication with the outer flow passage to pass waste combustion products therefrom.

4. In the combination as claimed in claim 3 wherein;

a. the shaped and sized generally hollow cylindrical means is formed from an insulating material having a relatively low coefficient of thermal conductivity and capable of withstanding the relatively high temperatures of the gaseous products of combustion formed in the firebox.

5. In the combination as claimed in claim 3 wherein the means for positioning and orienting the cylindrical means includes means for removably mounting the cylindrical means in the central space in the wound boiler.

6. In the combination as claimed in either of claims 4 or 5 including, an arcuate extension and guide projecting from the cylindrical means at a point adjacent the discharge outlet to guide and turn the flow of combustion products therefrom into the inner flow passage.

7. In the combination as claimed in claim 5 wherein, a. said discharge outlet in the wall means of the cylindrical means is oriented at the top section thereof in assembled position in the wound boiler, b. said cylindrical means has a back end closure, c. an arcuate extension adjacent the back end closure disposed for operative association with the discharge outlet for guiding and turning hot gaseous combustion products expanding and flowing from the combustion chamber in said cylindrical means into the inner flow passage.

8. In the combination as claimed in claim 3 wherein;

a. said wound boiler has a back end closure, b. said back end closure has an arcuate support bracket, c. said cylindrical member has the back end thereof operatively supported by said arcuate support bracket.

9. In the combination as claimed in claim 8 wherein means is provided on the exterior surface of the back end of the cylindrical means to minimize conductive heat loss from the cylindrical member to the back end closure of the wound boiler.

* * * * *